US011965522B2

(12) United States Patent
Chiu et al.

(10) Patent No.: US 11,965,522 B2
(45) Date of Patent: Apr. 23, 2024

(54) IMPELLER

(71) Applicant: DELTA ELECTRONICS, INC., Taoyuan (TW)

(72) Inventors: Pei-Han Chiu, Taoyuan (TW); Chien-Ming Lee, Taoyuan (TW); Chung-Yuan Tsang, Taoyuan (TW); Chao-Fu Yang, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 155 days.

(21) Appl. No.: 17/586,786

(22) Filed: Jan. 28, 2022

(65) Prior Publication Data

US 2022/0145899 A1 May 12, 2022

Related U.S. Application Data

(63) Continuation-in-part of application No. 16/710,739, filed on Dec. 11, 2019, now Pat. No. 11,236,760, (Continued)

(30) Foreign Application Priority Data

Dec. 11, 2015 (CN) ..... 201510923160.8
Aug. 27, 2021 (CN) ..... 202122039432.1

(51) Int. Cl.
*B63H 1/26* (2006.01)
*F04D 29/34* (2006.01)
(Continued)

(52) U.S. Cl.
CPC ..... *F04D 29/34* (2013.01); *F04D 29/384* (2013.01); *F04D 29/66* (2013.01)

(58) Field of Classification Search
CPC ..... F04D 19/002; F05D 2240/303; F05D 2240/304; F05D 2240/305; F05D 2240/306; F05D 2250/294; F05D 2240/307
(Continued)

(56) References Cited

U.S. PATENT DOCUMENTS 4,799,862 A 1/1989 Davidson et al.
5,320,493 A 6/1994 Shih et al.
(Continued)

FOREIGN PATENT DOCUMENTS

CN 1796798 A 7/2006
CN 100381707 C 4/2008
(Continued)

*Primary Examiner* — Long T Tran
*Assistant Examiner* — James J Kim
(74) *Attorney, Agent, or Firm* — CKC & Partners Co., LLC

(57) ABSTRACT

An impeller includes a hub and a plurality of blades. The blades are arranged around the hub, and each blade includes a leading edge, a blade tip, a root portion, a trailing edge, a windward side and a leeward side. The windward side including a first turning point and a second turning point, a first vertical height difference is formed from the blade tip to the first turning point, and a second vertical height difference is formed from the first turning point to the second turning point, and the first vertical height difference is greater than the second vertical height difference. The impeller apparently reduces the noise.

22 Claims, 11 Drawing Sheets

Related U.S. Application Data which is a continuation-in-part of application No. 15/010,648, filed on Jan. 29, 2016, now Pat. No. 10,539,149.

(51) Int. Cl.
*F04D 29/38* (2006.01)
*F04D 29/66* (2006.01)

(58) Field of Classification Search
USPC ..... 416/243
See application file for complete search history.

(56) References Cited

U.S. PATENT DOCUMENTS

| | | | | |
|---|---|---|---|---|
| 5,616,004 | A | 4/1997 | Alizadeh | |
| 6,142,733 | A | 11/2000 | Alizadeh et al. | |
| 6,994,523 | B2 | 2/2006 | Eguchi et al. | |
| 7,559,744 | B2 | 7/2009 | Suzuki et al. | |
| 9,556,881 | B2 | 1/2017 | Seiji et al. | |
| 9,816,521 | B2 | 11/2017 | Kumon et al. | |
| 10,344,764 | B2 * | 7/2019 | Nakamura | F04D 29/002 |
| 10,539,149 | B2 | 1/2020 | Chang et al. | |
| 10,662,973 | B2 * | 5/2020 | Yamazaki | F04D 29/384 |
| D910,834 | S | 2/2021 | Wang et al. | |
| D938,009 | S | 12/2021 | Robinson et al. | |
| D938,011 | S | 12/2021 | Robinson et al. | |
| 11,333,166 | B2 * | 5/2022 | Yamamoto | F04D 29/667 |
| 2005/0276693 | A1 | 12/2005 | Liu | |
| 2010/0189557 | A1 | 7/2010 | Broom | |
| 2012/0107127 | A1 | 5/2012 | Chang | |
| 2014/0086754 | A1 * | 3/2014 | Seiji | F04D 29/384 416/237 |
| 2014/0096290 | A1 | 4/2014 | Gibson | |
| 2014/0338388 | A1 | 11/2014 | Kim et al. | |
| 2015/0071786 | A1 | 3/2015 | Kumon et al. | |
| 2015/0092924 | A1 | 4/2015 | Yun et al. | |
| 2018/0238343 | A1 * | 8/2018 | Nakashima | F04D 29/384 |
| 2019/0107118 | A1 | 4/2019 | Arai et al. | |

FOREIGN PATENT DOCUMENTS

| | | | |
|---|---|---|---|
| CN | 101725566 | A | 6/2010 |
| CN | 201496290 | U | 6/2010 |
| CN | 1924364 | B | 9/2012 |
| CN | 103122872 | B | 2/2016 |
| CN | 209687797 | U | 11/2019 |
| EP | 1070849 | B1 | 3/2010 |
| EP | 3085966 | B1 | 5/2020 |
| KR | 20070006624 | A | 1/2007 |
| KR | 20070066240 | A | 6/2007 |
| TW | 585227 | U | 4/2004 |

* cited by examiner

IMPELLER

RELATED APPLICATIONS

This Non-provisional application is a Continuation-In-Part (CIP) application of U.S. application Ser. No. 16/710,739, filed Dec. 11, 2019, now U.S. Pat. No. 11,236,760, issued on Feb. 1, 2022, which is a Continuation-In-Part (CIP) application of U.S. application Ser. No. 15/010,648, filed Jan. 29, 2016, now U.S. Pat. No. 10,539,149, issued on Jan. 21, 2020, which claims priority to China Application Serial Number 201510923160.8 filed Dec. 11, 2015, and also claims priority to China Application Serial Number 202122039432.1 filed Aug. 27, 2021, the entire contents of which are hereby incorporated by reference.

TECHNICAL FIELD

The present disclosure generally relates to an impeller. More particularly, the present disclosure relates to a noise reduction impeller for an axial fan or diagonal fan.

BACKGROUND

With the advent of the 5G era, the amount of computation and transmission required by communication systems is increased. In order to deal with huge data computations, the central processing unit (CPU) and graphics processing unit (GPU) performance are continuously improved, and the power consumption of the CPU on the market has also increased from 250 watts in 2017 to more than 300 watts today. In order for the electronic device to work properly, the interior heat thereof must be effectively removed, and a forced convection is adopted by a fan.

According to direction relationship between the inlets and outlets of the fans, the fans can be classified into axial fans and centrifugal fans. In the ordinary axial fans, the inlet airflow and the outlet airflow are almost in the same direction.

The fan may generate noise due to friction or impact with the air when the blades rotate. In addition, the frequency of the noise is composed of multiple frequencies, and the frequencies of the noise are generally related to the speed of the fan. Therefore, there is a need to design a quieter fan to reduce the noise during the operation.

SUMMARY

One objective of the embodiments of the present invention is to provide an impeller able to reduce the noise during the operation.

To achieve these and other advantages and in accordance with the objective of the embodiments of the present invention, as the embodiment broadly describes herein, the embodiments of the present invention provides an impeller, for an axial fan, including a hub and a plurality of blades surrounding the hub. Each blade includes a leading edge, a blade tip, a root portion, a trailing edge, a windward side and a leeward side. The blade is connected to the hub through the root portion, the leading edge is connected to the hub and the blade tip at peripheral, and the trailing edge is opposite to the leading edge and is connected to the hub and the blade tip. Each blade is approximately a curved thin plane, and one surface of the blade is the windward side and another surface of the blade is the leeward side opposite to the windward side. The windward side includes a first turning point and a second turning point, a first vertical height difference is formed from the blade tip to the first turning point, a second vertical height difference is formed from the first turning point to the second turning point, and the first vertical height difference is greater than the second vertical height difference.

In some embodiments, the leading edge of the blade and the trailing edge of another blade next to the foregoing blade is not overlapped with each other in an axial projection.

In some embodiments, a peak structure is formed adjacent to the first turning point on the windward side.

In some embodiments, a groove structure is formed adjacent to the first turning point on the leeward side, and the groove structure is opposite to peak structure.

In some embodiments, the peak structure of the blade adjacent to the first turning point includes a projection angle on a horizontal section, and the projection angle is an acute angle.

In some embodiments, a length between the first turning point and the root portion is equal to 0.7 to 0.9 times a length between the root portion and the blade tip.

In some embodiments, a length between the first turning point and the root portion is equal to 0.8 times a length between the root portion and the blade tip.

In some embodiments, the first vertical height difference is 5 times greater than the second vertical height difference.

In some embodiments, the leading edge of the blade forms a leading edge projection line from the root portion gradually up to the blade tip on a radial projection.

In some embodiments, orientation angles of the leading edge of the blade are gradually increased from the root portion, and the orientation angles of the leading edge of the each of the blades are gradually decreased from 0.7 to 0.9 times a length between the root portion and the blade tip to the blade tip.

According to another aspect of the present invention, the present invention provides an impeller including a hub and a plurality of blades surrounding the hub. Each blade includes a leading edge, a blade tip, a root portion and a trailing edge. The blade includes a leading edge tip angle and a blade tip leading edge angle, and the leading edge tip angle is greater than the blade tip leading edge angle.

In some embodiments, the blade further includes a trailing edge tip angle and a blade tip trailing edge angle, and the trailing edge tip angle is greater than the blade tip trailing edge angle.

In some embodiments, the leading edge tip angle, the blade tip leading edge angle, the trailing edge tip angle and the blade tip trailing edge angle are between 20 degrees and 50 degrees.

In some embodiments, the blade further includes a leading edge tip angle and a trailing edge tip angle, and the trailing edge tip angle is greater than or equal to the leading edge tip angle.

In some embodiments, the leading edge tip angle is between 80 degrees and 120 degrees, and the trailing edge tip angle is between 90 degrees and 130 degrees.

In some embodiments, a difference between the trailing edge tip angle and the leading edge tip angle is less than 20 degrees.

In some embodiments, the trailing edge tip angle is greater than the leading edge tip angle.

In some embodiments, the blade further includes an upper leading edge tip radius and an upper trailing edge tip radius, and the upper trailing edge tip radius is greater than or equal to the upper leading edge tip radius.

In some embodiments, the blade further includes an upper blade tip leading edge radius and an upper blade tip trailing edge radius, and the upper blade tip trailing edge radius is greater than or equal to the upper blade tip leading edge radius.

In some embodiments, the upper trailing edge tip radius is greater than the upper leading edge tip radius, and the upper blade tip trailing edge radius is greater than the upper blade tip leading edge radius.

In some embodiments, the blade further includes an upper blade tip leading edge radius, an upper blade tip midpoint radius, an upper blade tip trailing edge radius, a lower blade tip trailing edge radius, a lower blade tip midpoint radius and a lower blade tip leading edge radius, and the lower blade tip trailing edge radius is greater than or equal to the upper blade tip trailing edge radius, the upper blade tip trailing edge radius is greater than or equal to the lower blade tip midpoint radius, the lower blade tip midpoint radius is greater than or equal to the upper blade tip midpoint radius, the upper blade tip midpoint radius is greater than or equal to the lower blade tip leading edge radius, and the lower blade tip leading edge radius is greater than or equal to the upper blade tip leading edge radius.

In some embodiments, the lower blade tip trailing edge radius is greater than the upper blade tip trailing edge radius, the upper blade tip trailing edge radius is greater than the lower blade tip midpoint radius, the lower blade tip midpoint radius is greater than the upper blade tip midpoint radius, the upper blade tip midpoint radius is greater than the lower blade tip leading edge radius and the upper blade tip leading edge radius.

Hence, the impeller disclosed in the present invention can effectively reduce the noise generated by the rotating blades and effectively reduce the broadband and narrowband noise thereof as compared with a conventional impeller so as to improve the fan characteristics.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

and

Figure 9:
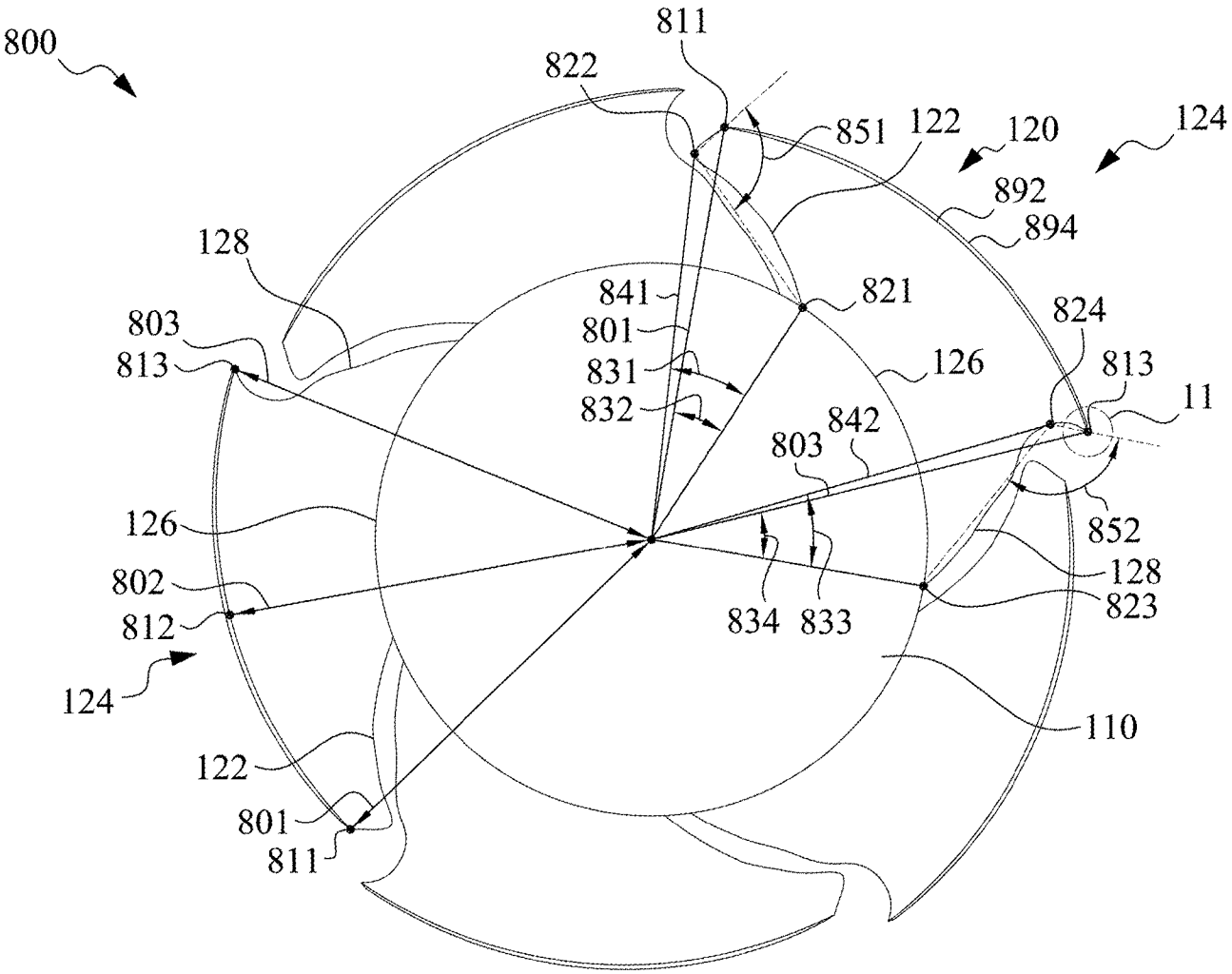
FIG. 9 illustrates a schematic top view showing an impeller according to further another embodiment of the present invention.
Figure 11:
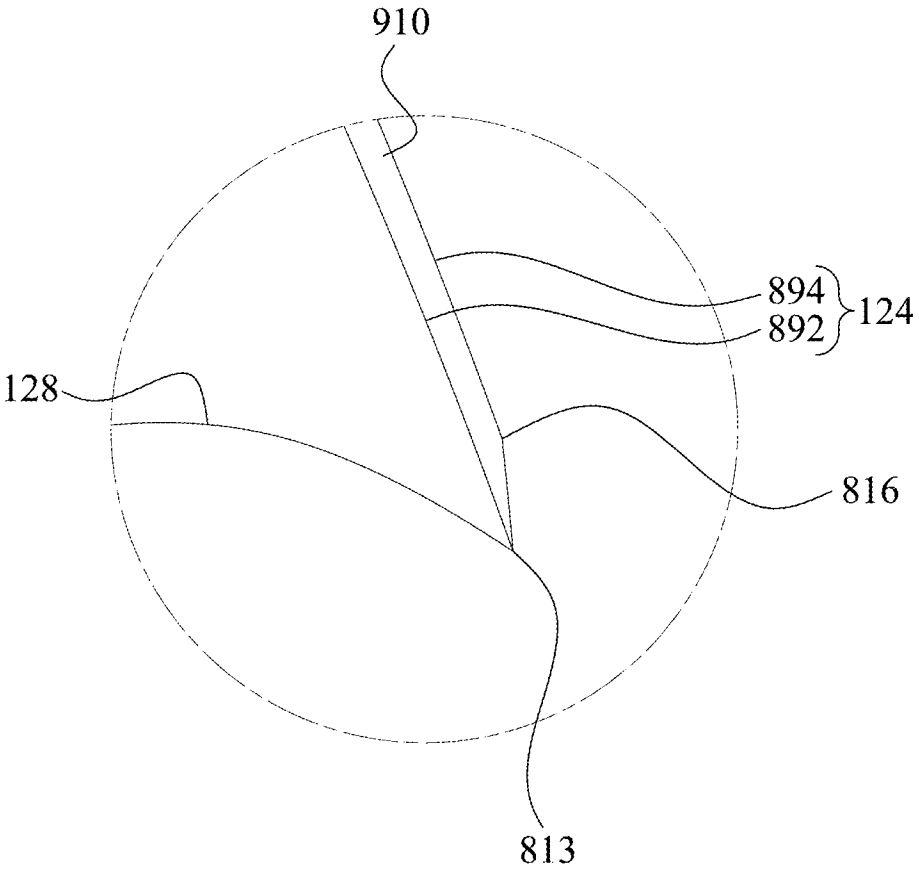

FIG. 11 illustrates a partial enlarged view of the impeller of FIG. 9.

DETAILED DESCRIPTION OF THE PREFERRED EMBODIMENT

The following description is of the best presently contemplated mode of carrying out the present disclosure. This description is not to be taken in a limiting sense but is made merely for the purpose of describing the general principles of the invention. The scope of the invention should be determined by referencing the appended claims.

Figure 1:
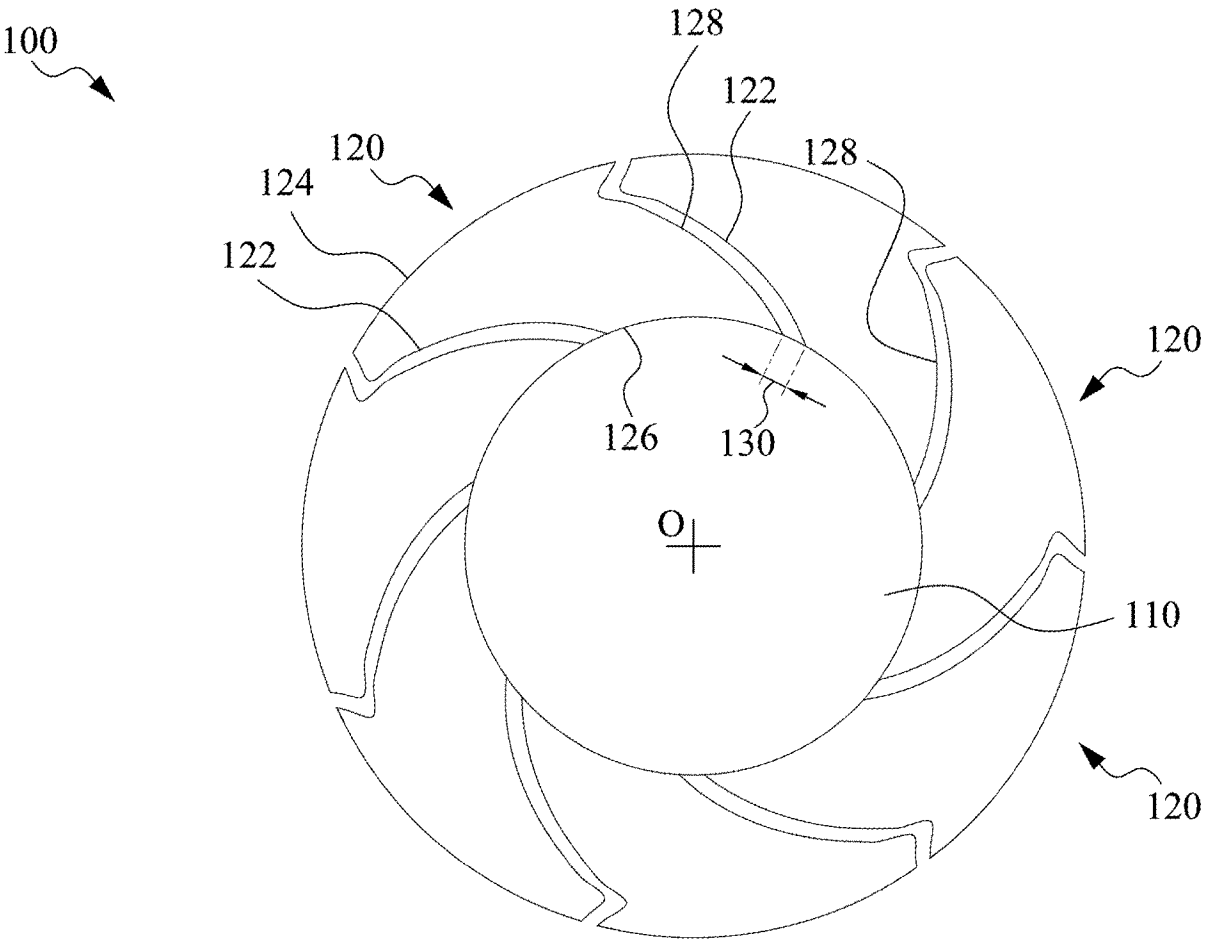
FIG. 1 illustrates a schematic top view showing an impeller according to one embodiment of the present invention.
Figure 2:
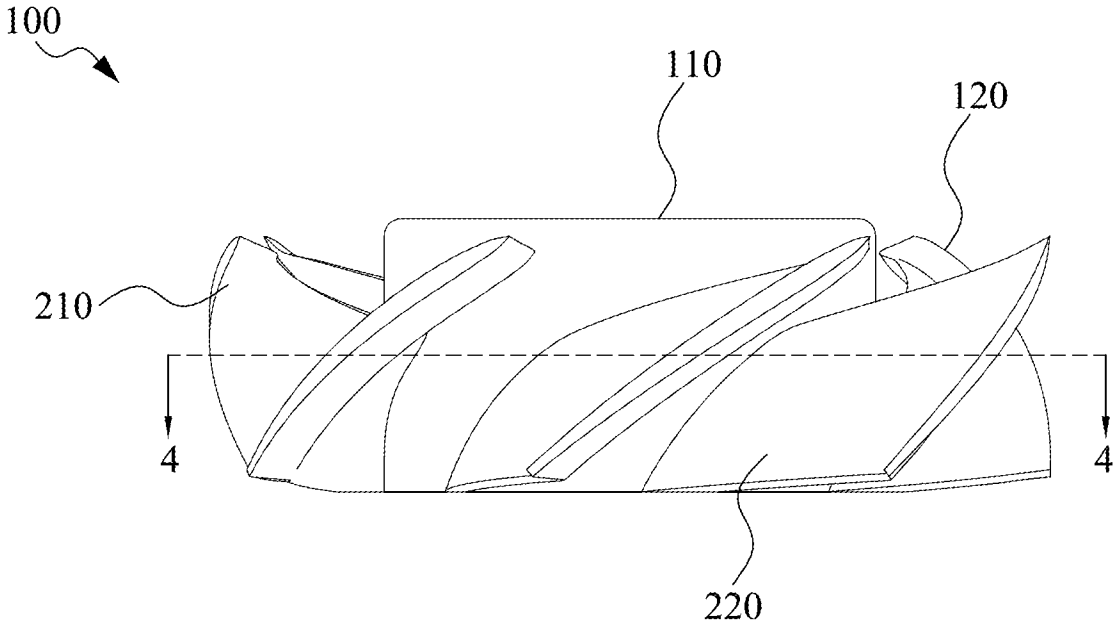
FIG. 2 illustrates a schematic side view of the impeller of FIG. 1.
Figure 3:
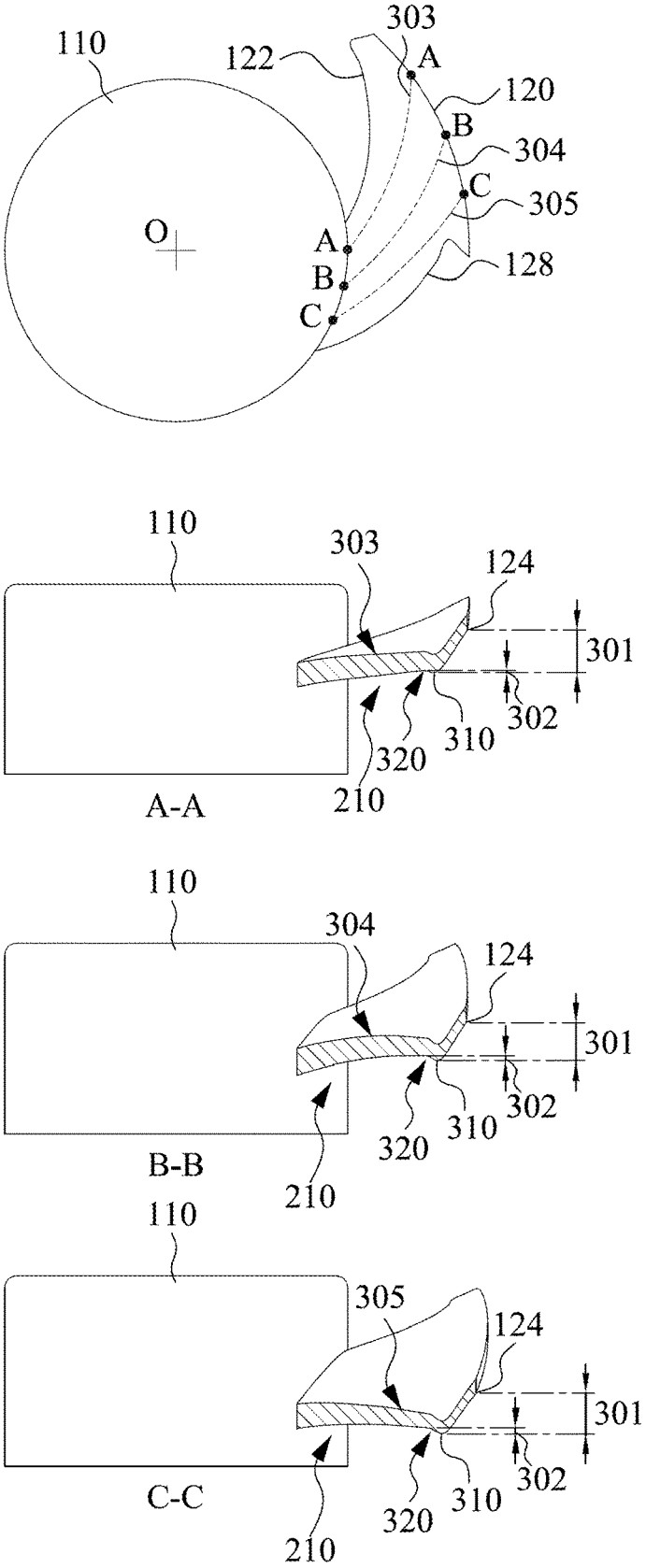
FIG. 3 illustrates a schematic cross sectional view showing a single blade of the impeller of FIG. 1.
Figure 4:
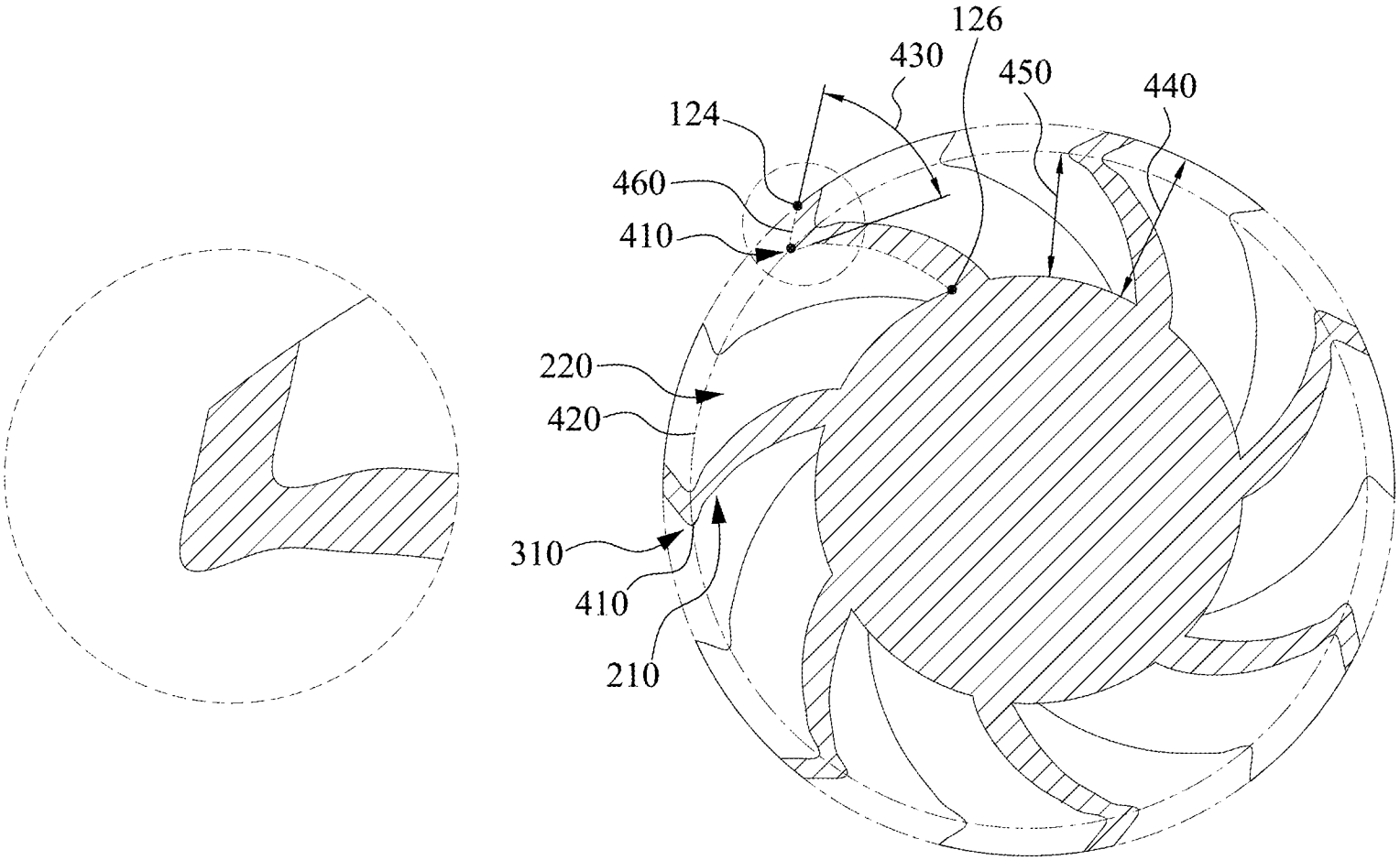
FIG. 4 illustrates a schematic cross sectional view taken along 4-4 of the impeller of FIG. 2.
Figure 5:
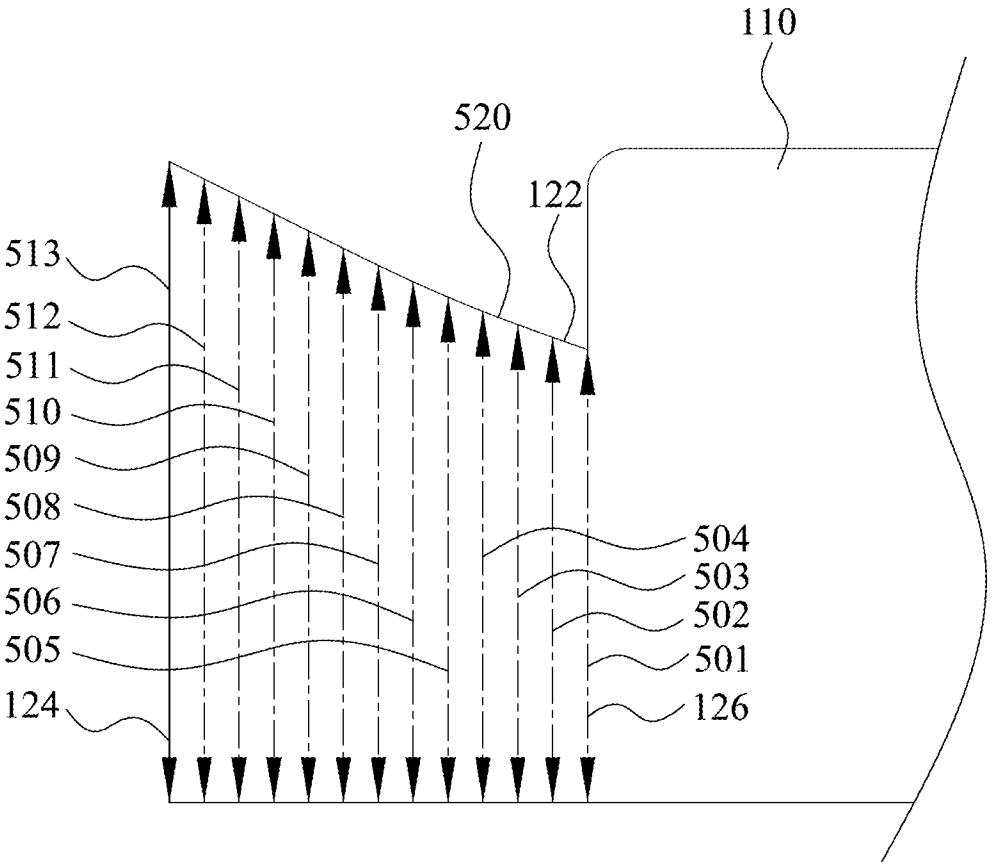
FIG. 5 illustrates a schematic side view of a single blade of the impeller of FIG. 1.
Figure 6:
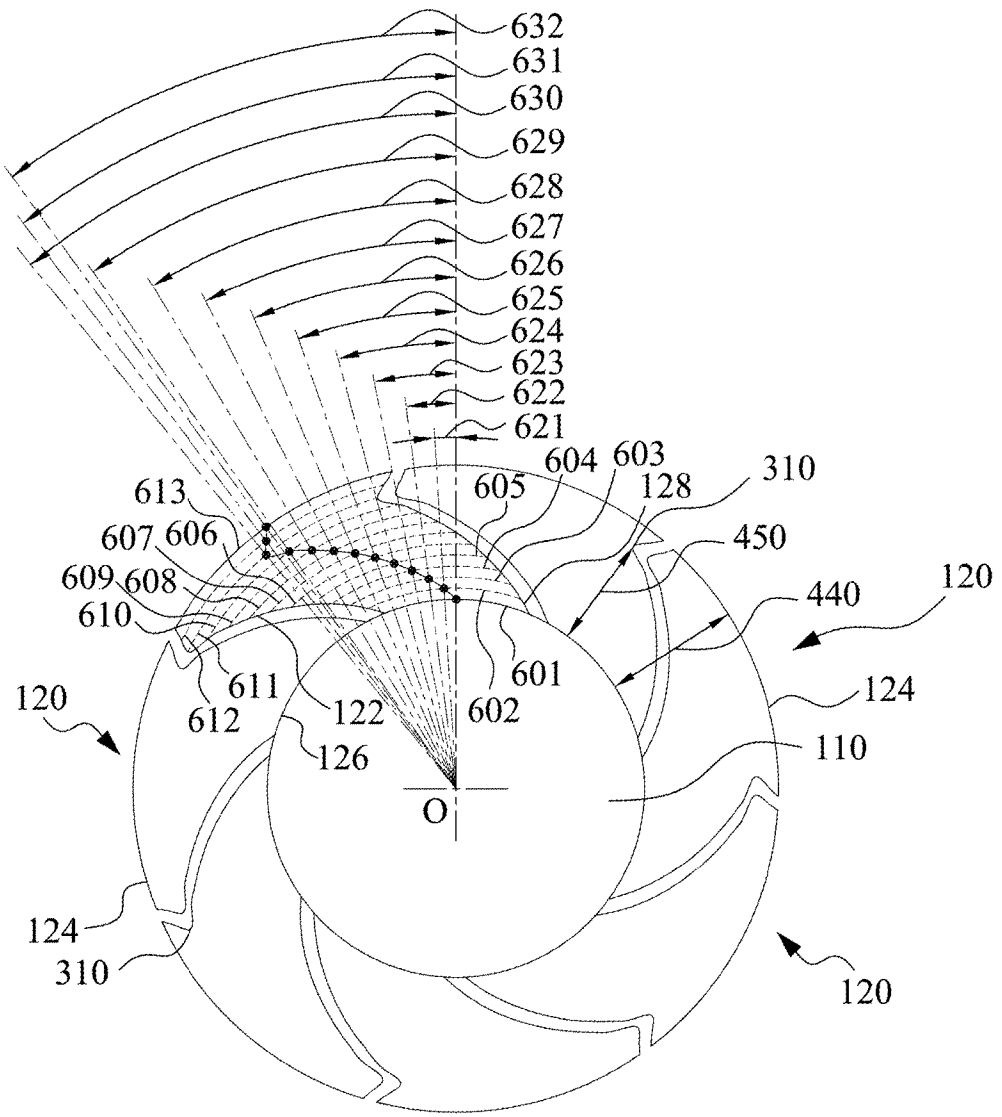
FIG. 6 illustrates an orientation angle of the blades of the impeller of FIG. 1.

FIG. 1 is a schematic top view showing an impeller according to one embodiment of the present invention, FIG. 2 is a schematic side view thereof, FIG. 3 is a schematic cross sectional view thereof, FIG. 4 is a schematic cross sectional view taken along 4-4 of the impeller of FIG. 2, FIG. 5 is a schematic side view the blade thereof, and FIG. 6 illustrates an orientation angle of the blade thereof.

Taking a schematic top view showing in FIG. 1 as an example, the impeller rotates counterclockwise according to one embodiment of the present invention.

As shown in FIG. 1, an impeller 100 includes a hub 110 and a plurality of blades 120. The plurality of blades 120 are surrounded on the hub 110. Each of the blades 120 includes a leading edge 122, a blade tip 124, a root portion 126, a trailing edge 128, a windward side 210 facing the rotation direction and a leeward side 220. The blades 120 are connected to the hub 110 through the root portion 126. The leading edge 122 is a windward edge of the blade 120 and connects to the hub 110 and the blade tip 124 on the peripheral of the blade 120 when the impeller rotates counterclockwise. The trailing edge 128 is located opposite to the leading edge 122 and connects to the hub 110 and the blade tip 124. Refer also to FIGS. 1 and 2, the shape of the blades 120 is approximately a curved thin plane. The windward side 210 is on the backside of the blade 120 in FIG. 1 as well as the bottom side of the blade 120 in FIG. 2, and the leeward side 220 is opposite to the windward side 210. Two curved surfaces of the windward side 210 and the leeward side 220 approximately converge on the leading edge 122, the blade tip 124 and the trailing edge 128. The leading edge 122, the blade tip 124 and the trailing edge 128 are curved junction lines of the windward side 210 and the leeward side 220.

As referred to FIG. 1, in the top view of the impeller 100, when the line of vision is parallel to the rotational axis of the impeller, i.e. the hub axis O, the trailing edge 128 of each blade 120 and the leading edge 122 of a blade next to the each blade 120 are not overlapped with each other in the axial projection of the impeller 100. An interval 130 is formed between the two adjacent blades 120. That is to say, the projection areas of the blades 120 are not overlapped in the axial projection of the impeller 100.

In addition, simultaneously referring to FIG. 3, an A-A section 303, a B-B section 304 and a C-C section 305 of the blade 120 are illustrated. The B-B section 304 is a schematic sectional view of the midpoint of the blade 120, the A-A section 303 is a schematic sectional view of the midpoint of the leading edge 122 of the blade 120 and the B-B section 304 of the blade 120, and the C-C section 305 is a schematic sectional view of the midpoint of the B-B section 304 of the blade 120 and the trailing edge 128 of the blade 120.

As shown in the A-A section 303, the B-B section 304 and the C-C section 305, the windward side 210 includes a first turning point 310 and a second turning point 320, and a first vertical height difference 301 is formed from the blade tip 124 to the first turning point 310, and a second vertical height difference 302 is formed from the first turning point 310 to the second turning point 320. It is worth noting that, the first vertical height difference 301 is greater than the second vertical height difference 302 in the A-A section 303, the B-B section 304 as well as the C-C section 305.

In the present invention, the turning point is meaning that a point at which the curve function of the blade section changes. As referred to the A-A section 303, B-B section 304 and C-C section 305 of the windward side 210 of FIG. 3, a first turning point is formed between a first curve and a second curve, the first curve is extended from the blade tip 124 of the blade 120 toward the hub 110 and the first turning point is formed at the position that the first curve is converted into the second curve, a third curve is continuously extended from the second curve and the second turning point 320 is formed between the second curve and the third curve. In addition, the third curve is extended to the hub 110.

Further referring to FIG. 4, a horizontal section of the blade 120 and hub 110 taken along 4-4 of the impeller 100 of FIG. 2 to illustrate the horizontal section of the blade 120 at the vertical midpoint of the blade 120. As viewed from the axial direction of the impeller 100 of FIG. 4, the windward side 210 forms a peak structure 410, the peak structure 410 is adjacent to the first turning point 310 as shown in FIG. 3. A groove structure 420 is formed on the leeward side 220 and opposite to the peak structure 410.

Continuously referring to FIG. 4, on the horizontal section of the blade 120, the windward side 210 forms a projection angle 430 at the peak structure 410 on the axial projection, and the projection angle 430 is an acute angle.

The tip of the blade 120, that is, the peak structure 410 on the windward side 210 is designed to be an acute shape to allow the blade tip 124 having enough space to form an upturned extension. Therefore, the blade tip 124 of the blade 120 is forward and upturned to enlarge the length of the inclined plane 460 between the blade tip 124 and the peak structure 410 so as to reduce the slope of the inclined plane 460 and effectively reduce a high pressure area near the blade tip 124. Therefore, the high pressure area is moved closer to the root portion 126 to improve the pressure gradient and pressure value near the blade tip 124 and then effectively reduce the noise when the blade 120 rotates.

Referring to FIG. 3 again, the blade 120 of the impeller 100 forms a forward tip feature at the position of the first turning point 310 to move the high pressure area of the blade tip 124 of the blade 120 toward the root portion. Therefore, the windward side 210 of the blade 120 at the area of the blade tip 124 is formed a curve that first descends and then rises.

The second turning point 320 is a starting point of the descendent curve, and the first turning point 310 is a lowest point of the peak structure. In addition, the first vertical height difference 301 is greater than the second vertical height difference 302. Preferably, the first vertical height difference 301 is about 5 times greater than the second vertical height difference 302, so that the pressure between the blade 120 and the frame wall of the fan frame can be varied slowly to reduce the vortex at the blade tip 124 so as to reduce the noise of the impeller.

Therefore, the impeller 100 can push the high pressure area on the windward side 210 toward the hub 110 to reduce the pressure at the blade tip 124 while rotating. The inclined plane of the blade tip 124 is extended to reduce the slope of the inclined plane so that the flow channel area can change slowly to reduce the pressure variation between the blade 120 and the frame wall of the fan frame so as to effectively reduce the noise caused by the blade tip 124 of the blade 120 and effectively suppress the broadband and narrowband noise of the blade 120 so as to keep the noise low and maintain the characteristics of the impeller. In some embodiments, the impeller 100 can reduce the noise by approximately 3 to 4 dB compared with an impeller without such a blade tip 124.

In some embodiments, the depth of the groove structure 420 is equal to the protruding height of the peak structure 410.

Referring to FIG. 5, the blade 120 is radially divided into 12 equal parts from the root portion 126 to the blade tip 124 as viewed from the side view thereof. Therefore, the blade 120 is radially divided into 12 equal parts so as to get 13 lines on the blade 120. The height 501 is a height of the blade 120 closest to the root portion 126, the height 513 is a height of the blade 120 at the blade tip 124, and the blade 120 are divided into 12 equal parts to form the height 502 to height 512 between the height 501 and the height 513. As can be seen from FIG. 5 that the height of the leading edge 122 of the blade 120 in the radial projection (which is perpendicular to the aforementioned axial projection) gradually increases from the hub 110 to the blade tip 124. The height of the leading edge 122 of the blade 120 forms a leading edge projection line 520 gradually upward from the root portion 126 to the blade tip 124 in radial projection. That is, the height 501 of the blade 120 is less than the height 502, the height 502 is less than height 503, and the height of blade 120 gradually increases from the height 501 to the height 513.

Referring to FIG. 6, the orientation angle of the blade 120 of the impeller 100 is illustrated to show the variation from the orientation angle 621 to the orientation angle 632 of the blade 120 and the wing-shaped curve of the blade 120. As shown in FIG. 6, on the axial projection plane, the blade 120 is radially divided into 12 equal parts from the root portion 126 to the blade tip 124 to form section arc lines 601 to 613. Each section arc line illustrates a midpoint between the leading edge 122 and the trailing edge 128 as indicated by the black dots in FIG. 6. The orientation angle 621 is defined as an included angle between the line connecting the center of the hub 110 and the midpoint of the section arc line 602 and the line connecting the center of the hub 110 and the midpoint of the section arc line 601. In the same manner, the orientation angle 622 is an included angle between the line connecting the center of the hub 110 and the midpoint of the section arc line 603 and the line connecting the center of the hub 110 and the midpoint of the section arc line 601.

It is worth noting that the orientation angles are gradually increased from the root portion 126 to the blade tip 124, that is, the orientation angle 622 is greater than the orientation angle 621, the orientation angle 623 is greater than the orientation angle 622 and then gradually increased. The orientation angle 630 is the maximum orientation angle, that is, the midpoint of the tenth section arc line 611 defines the maximum orientation angle while the blade 120 is divided into 12 equal parts from the root portion 126 to the blade tip 124. In addition, the orientation angle is then gradually decreased, that is, the orientation angle 631 is less than the orientation angle 630, and the orientation angle 632 is less than the orientation angle 631.

In other words, the orientation angle is gradually increased from the root portion 126 to 0.7 to 0.9 times the length 440 of the blade tip 124. In addition, from the orientation angle 630 to the blade tip 124, the orientation angle is gradually decreased.

In some embodiments, a length 450 of the first turning point 310 apart from the root portion 126 is approximately 0.7 to 0.9 times the length 440 between the root portion 126 and blade tip 124. In some embodiments, the length 450 of the first turning point 310 apart from the root portion 126 is approximately 0.8 times the length 440 between the root portion 126 and blade tip 124.

Figure 7:
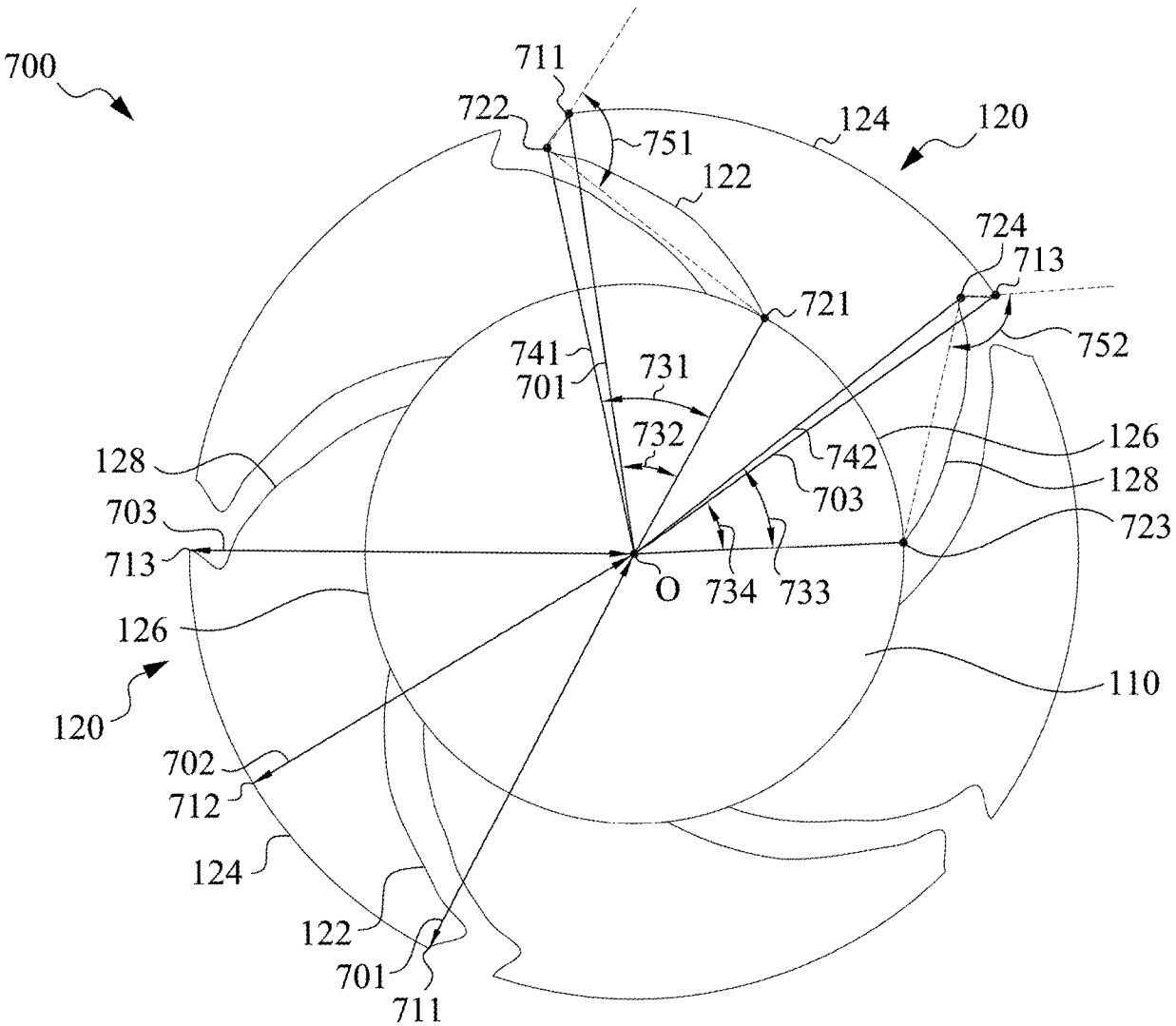
FIG. 7 illustrates a schematic top view showing an impeller according to another embodiment of the present invention.
Figure 8:
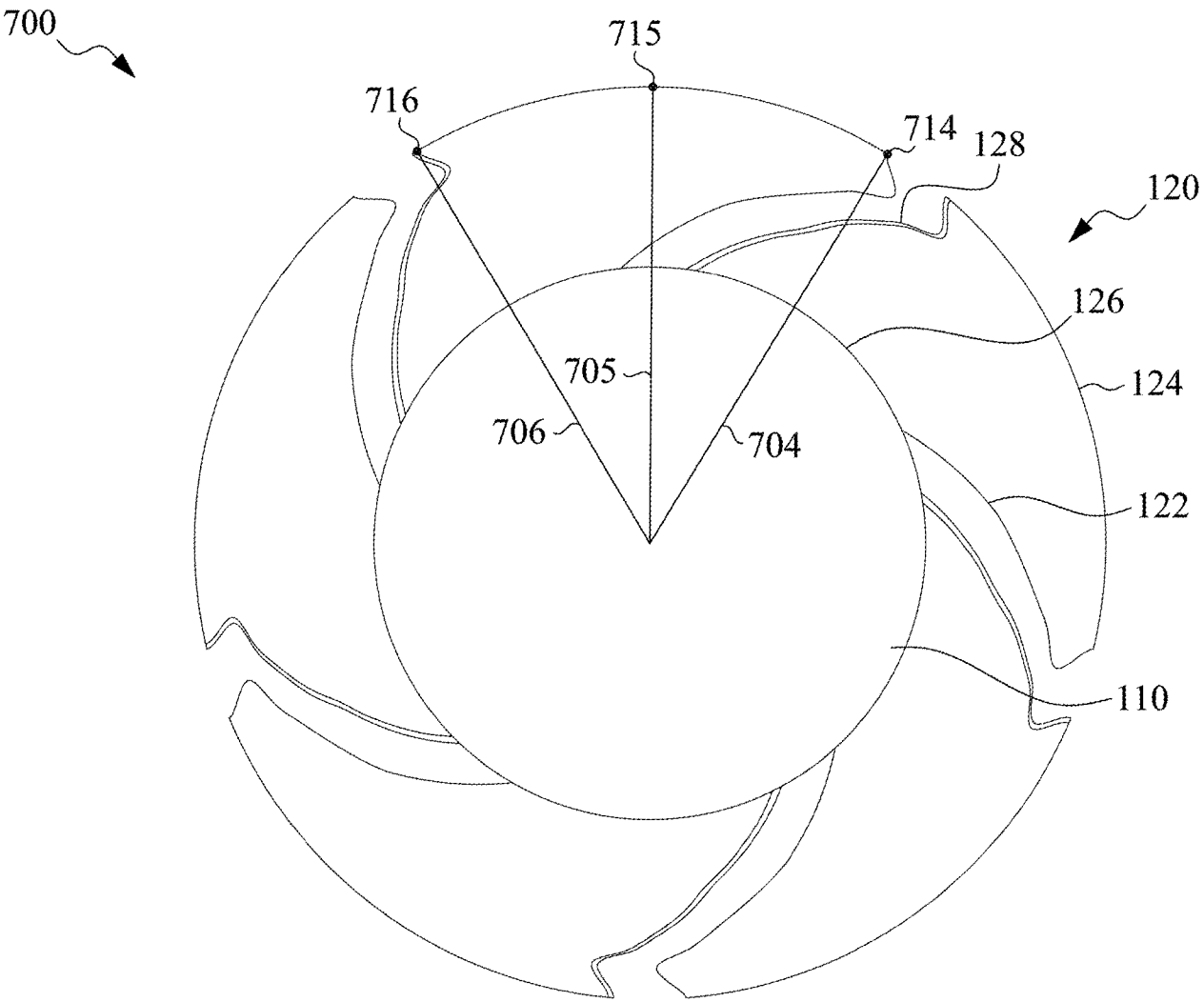
FIG. 8 illustrates a schematic bottom view of the impeller of FIG. 7.
Figure 10:
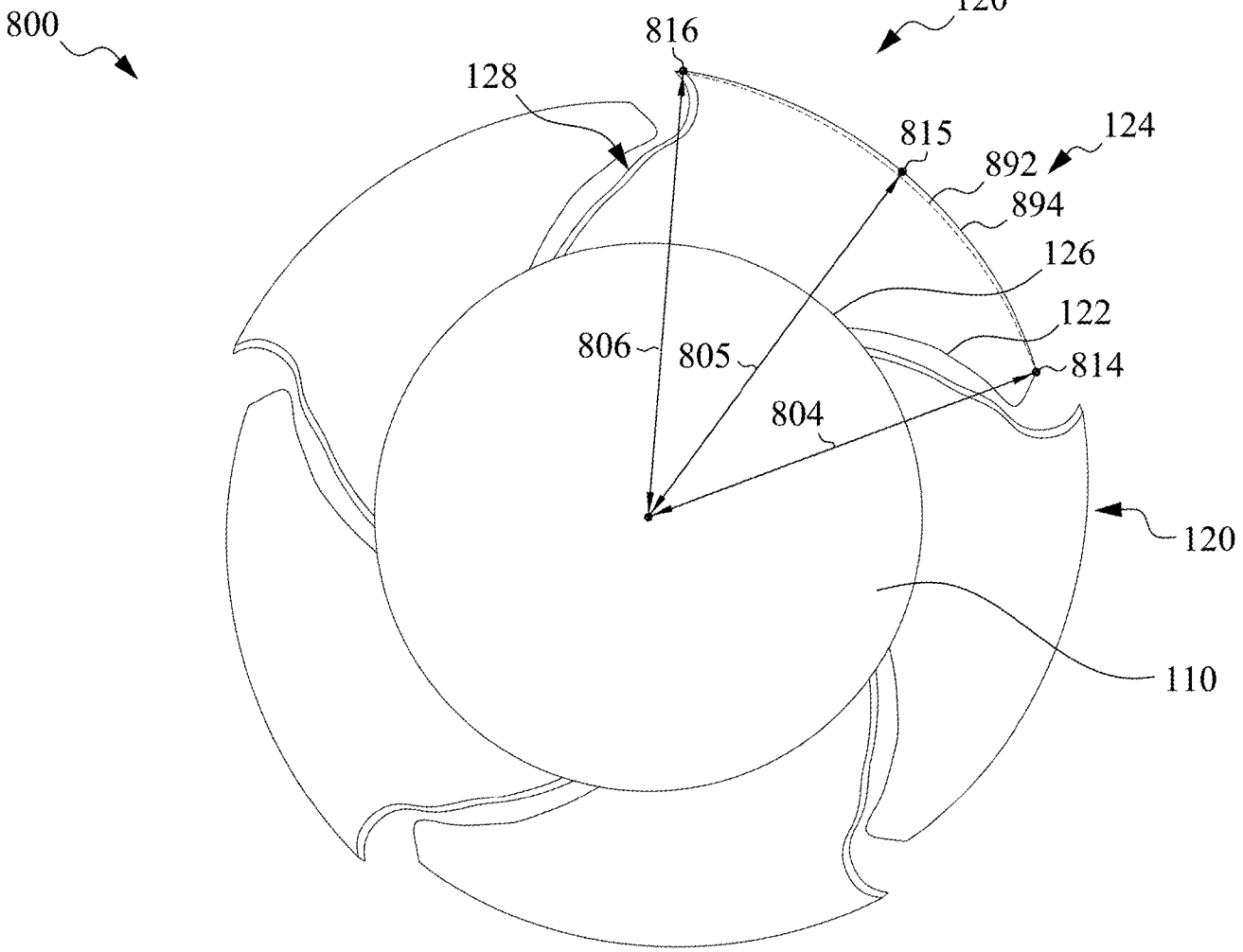
FIG. 10 illustrates a schematic bottom view of the impeller of FIG. 9.

Further referring to FIGS. 7 to 11, FIG. 7 is a schematic top view showing an impeller according to another embodiment of the present invention, FIG. 8 is a schematic bottom view thereof, FIG. 9 is a schematic top view showing an impeller according to further another embodiment of the present invention, FIG. 10 is a schematic bottom view thereof, and FIG. 11 is a partial enlarged view thereof.

The impeller shown in FIGS. 7 and 8 is preferably used for a fan having a cylindrical inner frame wall, for example, an axial fan. In addition, the impeller shown from FIGS. 9 to 11 is preferably used in fans with a truncated cone inner frame wall, such as a diagonal flow fan with an inner frame wall having a smaller top diameter and a larger bottom diameter inner frame wall. In addition, the impeller from FIGS. 7 to 11 can also have a cylindrical shape, a truncated cone shape or an arc surface hub without departing from the spirit and scope of the present invention.

In FIG. 7, the impeller 700 includes a hub 110 and a plurality of blades 120 surrounding the hub 110. Each blade 120 includes a leading edge 122, a blade tip 124, a root portion 126 and a trailing edge 128. Each blade 120 further includes a leading edge tip angle 731 and a blade tip leading edge angle 732, and the leading edge tip angle 731 is greater than the blade tip leading edge angle 732. In addition, the leading edge tip angle 731 is an included angle between the line connecting the leading edge tip point 722 and the hub axis O and the line connecting the leading edge root point 721 and the hub axis O. Furthermore, the blade tip leading edge angle 732 is an included angle between the line connecting the upper blade tip leading edge point 711 and the hub axis O and the line connecting the leading edge root point 721 and the hub axis O.

In some embodiments, each blade 120 further includes a trailing edge tip angle 733 and a blade tip trailing edge angle 734, and the trailing edge tip angle 733 is greater than the blade tip trailing edge angle 734. In addition, the trailing edge tip angle 733 is an included angle between the line connecting the upper trailing edge tip point 724 and the hub axis O and the line connecting the trailing edge root point 723 and the hub axis O. Furthermore, the blade tip trailing edge angle 734 is an included angle between the line connecting the upper blade tip trailing edge point 713 and the hub axis O and the line connecting the trailing edge root point 723 and the hub axis O.

In some embodiments, the leading edge tip angle 731, the blade tip leading edge angle 732, the trailing edge tip angle 733 and the blade tip trailing edge angle 734 are preferably between about 20 degrees to 50 degrees.

In some embodiments, each blade 120 includes a leading edge tip angle 751 and a trailing edge tip angle 752, and the trailing edge tip angle 752 is preferably greater than the leading edge tip angle 751. The leading edge tip angle 751 is an included angle between the line connecting the upper blade tip leading edge point 711 and the leading edge tip point 722 and the line connecting the leading edge root point 721 and the leading edge tip point 722. In some embodiments, the leading edge tip angle 751 is between 80 degrees and 120 degrees. In addition, the trailing edge tip angle 752 is an included angle between the line connecting the upper blade tip trailing edge point 713 and the upper trailing edge tip point 724 and the line connecting the trailing edge root point 723 and the upper trailing edge tip point 724. In some embodiments, the trailing edge tip angle 752 is between 90 degrees and 130 degrees.

In some embodiments, as shown in FIGS. 7 and 8, the difference between the trailing edge tip angle 752 and the leading edge tip angle 751 is less than 20 degrees.

In some embodiments, each blade 120 further includes an upper leading edge tip radius 741 and an upper trailing edge tip radius 742, and the upper trailing edge tip radius 742 is equal to the upper leading edge tip radius 741. In addition, the upper leading edge tip radius 741 is a length from the leading edge tip point 722 to hub axis O, and the upper trailing edge tip radius 742 is a length from the upper trailing edge tip point 724 to the hub axis O.

In some embodiments, each blade 120 further includes an upper blade tip leading edge radius 701 and an upper blade tip trailing edge radius 703, and the upper blade tip trailing edge radius 703 is equal to the upper blade tip leading edge radius 701. In addition, the upper blade tip leading edge radius 701 is a length from the upper blade tip leading edge point 711 to the hub axis O, and the upper blade tip trailing edge radius 703 is a length from the upper blade tip trailing edge point 713 to the hub axis O.

In some embodiments, each blade 120 further includes an upper blade tip leading edge radius 701, an upper blade tip midpoint radius 702, an upper blade tip trailing edge radius 703, a lower blade tip trailing edge radius 706, a lower blade tip midpoint radius 705 and a lower blade tip leading edge radius 704. The lower blade tip trailing edge radius 706 is equal to the upper blade tip trailing edge radius 703, the upper blade tip trailing edge radius 703 is equal to the lower blade tip midpoint radius 705, the lower blade tip midpoint radius 705 is equal to the upper blade tip midpoint radius 702, the upper blade tip midpoint radius 702 is equal to the lower blade tip leading edge radius 704, and the lower blade tip leading edge radius 704 is equal to the upper blade tip leading edge radius 701.

In addition, the upper blade tip midpoint radius 702 is a length from the upper blade tip midpoint 712 to the hub axis O. The lower blade tip leading edge radius 704 is a length from the lower blade tip leading edge point 714 to the hub axis O, the lower blade tip midpoint radius 705 is a length from the lower blade tip midpoint 715 to the hub axis O, and the lower blade tip trailing edge radius 706 is a length from the lower blade tip trailing edge point 716 to the hub axis O.

In addition, the upper and the lower are for the convenience of explaining the shape and size of each part of the blade 120 of the impeller 700, and are marked in the directions in the drawings, but they are not intended to limit the spirit and scope of the present invention. The impeller can also be rotated in the opposite direction, or used upside down, without departing from the spirit and scope of the present invention.

Furthermore, as shown in FIG. 9, the impeller 800 includes a hub 110 and a plurality of blade 120 surrounding the hub 110. Each blade 120 includes a leading edge 122, a blade tip 124, a root portion 126 and a trailing edge 128. Each blade 120 further includes a leading edge tip angle 831 and a blade tip leading edge angle 832, and the leading edge tip angle 831 is greater than the blade tip leading edge angle 832. In addition, the leading edge tip angle 831 is an included angle between the line connecting the leading edge tip point 822 and the hub axis O and the line connecting the leading edge root point 821 and the hub axis O. Furthermore, the blade tip leading edge angle 832 is an included angle between the line connecting the upper blade tip leading edge point 811 and the hub axis O and the line connecting the leading edge root point 821 and the hub axis O.

In some embodiments, each blade 120 further includes a trailing edge tip angle 833 and a blade tip trailing edge angle 834, and the trailing edge tip angle 833 is greater than the blade tip trailing edge angle 834. In addition, the trailing edge tip angle 833 is an included angle between the line connecting the upper trailing edge tip point 824 and the hub axis O and the line connecting the trailing edge root point 823 and the hub axis O. Furthermore, the blade tip trailing edge angle 834 is an included angle between the line connecting the upper blade tip trailing edge point 813 and the hub axis O and the line connecting the trailing edge root point 823 and the hub axis O.

In some embodiments, the leading edge tip angle 831, the blade tip leading edge angle 832, the trailing edge tip angle 833 and the blade tip trailing edge angle 834 are preferably between 20 degrees and 50 degrees.

In some embodiments, each blade 120 includes a leading edge tip angle 851 and a trailing edge tip angle 852, and preferably the trailing edge tip angle 852 is greater than the leading edge tip angle 851. The leading edge tip angle 851 is an included angle between the line connecting the upper blade tip leading edge point 811 and the leading edge tip point 822 and the line connecting the leading edge root point 821 and the leading edge tip point 822. In some embodiments, the leading edge tip angle 851 is between 80 degrees and 120 degrees. In addition, the trailing edge tip angle 852 is an included angle between the line connecting the upper blade tip trailing edge point 813 and the upper trailing edge tip point 824 and the line connecting the trailing edge root point 823 and the upper trailing edge tip point 824. In some embodiments, the trailing edge tip angle 852 is about 90 degrees to 130 degrees.

In some embodiments, as shown in FIGS. 9 and 10, the difference between the trailing edge tip angle 852 and the leading edge tip angle 851 is less than 20 degrees.

In some embodiments, each blade 120 further includes an upper leading edge tip radius 841 and an upper trailing edge tip radius 842, and the upper trailing edge tip radius 842 is greater than the upper leading edge tip radius 841. In addition, the upper leading edge tip radius 841 is a length between the leading edge tip point 822 and the hub axis O, and the upper trailing edge tip radius 842 is a length between the upper trailing edge tip point 824 and the hub axis O.

In some embodiments, each blade 120 further includes an upper blade tip leading edge radius 801 and an upper blade tip trailing edge radius 803, and the upper blade tip trailing edge radius 803 is greater than the upper blade tip leading edge radius 801. In addition, the upper blade tip leading edge radius 801 is a length between the upper blade tip leading edge point 811 and the hub axis O, and the upper blade tip trailing edge radius 803 is a length between the upper blade tip trailing edge point 813 and the hub axis O.

In some embodiments, each blade 120 further includes an upper blade tip leading edge radius 801, an upper blade tip midpoint radius 802, an upper blade tip trailing edge radius 803, a lower blade tip trailing edge radius 806, a lower blade tip midpoint radius 805 and a lower blade tip leading edge radius 804. The lower blade tip trailing edge radius 806 is greater than the upper blade tip trailing edge radius 803, the upper blade tip trailing edge radius 803 is greater than the lower blade tip midpoint radius 805, the lower blade tip midpoint radius 805 is greater than the upper blade tip midpoint radius 802, the upper blade tip midpoint radius 802 is greater than the lower blade tip leading edge radius 804, and the lower blade tip leading edge radius 804 is greater than the upper blade tip leading edge radius 801.

In some embodiments, the lower blade tip trailing edge radius 806 is greater than the upper blade tip trailing edge radius 803, the upper blade tip trailing edge radius 803 is greater than the lower blade tip midpoint radius 805, the lower blade tip midpoint radius 805 is greater than the upper blade tip midpoint radius 802, the upper blade tip midpoint radius 802 is greater than the lower blade tip leading edge radius 804 and the upper blade tip leading edge radius 801.

In some embodiments, referring to FIG. 11, an inclined surface is formed between the upper blade tip trailing edge point 813 of FIG. 9 and the lower blade tip trailing edge point 816 of FIG. 10 so that the diameter of the lower blade tip trailing edge point 816 is greater than the diameter of the upper blade tip trailing edge point 813. However, the diameter of the lower blade tip trailing edge point 816 can equal to the diameter of the upper blade tip trailing edge point 813 without departing from the spirit and scope of the present invention. In addition, when the impeller 800 has an inclined surface 910, the blade tip 124 can form an upper blade tip arc line 892 and a lower blade tip arc line 894.

In some embodiments, the upper blade tip leading edge point 811 and the lower blade tip leading edge point 814 can be the same point, but not limited to this. An inclined surface 910 can be formed thereon so that the lower blade tip leading edge point 814 is greater than the upper blade tip leading edge point 811 without departing from the spirit and scope of the present invention.

In addition, the upper blade tip midpoint radius 802 is a length between the upper blade tip midpoint 812 and the hub axis O. The lower blade tip leading edge radius 804 is a length between the lower blade tip leading edge point 814 and the hub axis O, the lower blade tip midpoint radius 805 is a length between the lower blade tip midpoint 815 and the hub axis O, and the lower blade tip trailing edge radius 806 is a length between the lower blade tip trailing edge point 816 and the hub axis O.

In the same manner, the upper and the lower are for the convenience of explaining the shape and size of each part of the blade 120 of the impeller 800, and are marked in the directions in the drawings, but they are not intended to limit the spirit and scope of the present invention. The impeller can also be rotated in the opposite direction, or used upside down, without departing from the spirit and scope of the present invention.

As compared with a traditional impeller, the impeller disclosed in the present invention can increase the air volume and improve the overall fan efficiency at the same rotational speed. The blade disclosed in the present invention can be further used in a diagonal flow fan. In addition, under the same operating situation, the noise of the air inlet of the fan disclosed by the present invention is significantly reduced, and the noise of the air outlet is also reduced, thereby effectively reducing the narrowband noise of the fan blade and the overall broadband noise and improving the characteristics of the fan blade.

Accordingly, the impeller disclosed in the present invention can effectively reduce the noise generated by the rotating blades and effectively reduce the broadband and narrowband noise thereof, and can improve the fan characteristics to maintain a lower noise rotation. In addition, the impeller disclosed in the present invention can be used in the axial-flow fan or the diagonal-flow fan, without departing from the spirit and scope of the present invention.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. An impeller, comprising:

a hub; and a plurality of blades surrounding the hub, each of the blades comprising a leading edge, a blade tip, a root portion, a trailing edge, a windward side and a leeward side;

wherein each of the blades is connected to the hub through the root portion, the leading edge is connected to the hub and the blade tip at peripheral, and the trailing edge is opposite to the leading edge and is connected to the hub and the blade tip;

wherein each of the blades is approximately a curved thin plane, one surface of the blade is the windward side and another surface of the blade is the leeward side opposite to the windward side; and wherein the windward side comprises a first turning point and a second turning point located at a line connecting midpoints of the blade, a first vertical height difference is formed from the blade tip to the first turning point, a second vertical height difference is formed from the first turning point to the second turning point, and the first vertical height difference is greater than the second vertical height difference.

2. The impeller of claim 1, wherein the leading edge of the each of the blades and a trailing edge of another blade next to the each of the blades is not overlapped with each other in an axial projection.

3. The impeller of claim 2, wherein a peak structure is formed adjacent to the first turning point on the windward side.

4. The impeller of claim 3, wherein a groove structure is formed adjacent to the first turning point on the leeward side, and the groove structure is opposite to peak structure.

5. The impeller of claim 3, wherein the peak structure of each of the blades adjacent to the first turning point comprises a projection angle on a horizontal section, and the projection angle is an acute angle.

6. The impeller of claim 2, wherein a length between the first turning point and the root portion is equal to 0.7 to 0.9 times a length between the root portion and the blade tip.

7. The impeller of claim 6, wherein a length between the first turning point and the root portion is equal to 0.8 times a length between the root portion and the blade tip.

8. The impeller of claim 2, wherein the first vertical height difference is 5 times greater than the second vertical height difference.

9. The impeller of claim 2, wherein the leading edge of the each of the blades forms a leading edge projection line from the root portion gradually up to the blade tip on a radial projection.

10. The impeller of claim 2, wherein orientation angles of the leading edge of the each of the blades are gradually increased from the root portion, and the orientation angles of the leading edge of the each of the blades are gradually decreased from 0.7 to 0.9 times a length between the root portion and the blade tip to the blade tip.

11. An impeller, comprising:

a hub; and a plurality of blades surrounding the hub, each of the blades comprising a leading edge, a blade tip, a root portion and a trailing edge, wherein the each of the blades comprising a leading edge tip angle and a blade tip leading edge angle, and the leading edge tip angle is greater than the blade tip leading edge angle, wherein the leading edge tip angle is an included angle between a line connecting a leading edge tip point located above a first turning point of a windward side of the blade and a hub axis and a line connecting a leading edge root point and the hub axis, and the blade tip leading edge angle is an included angle between a line connecting an upper blade tip leading edge point located on a peripheral of the blade and the hub axis and the line connecting the leading edge root point and the hub axis.

12. The impeller of claim 11, wherein the each of the blades further comprises a trailing edge tip angle and a blade tip trailing edge angle, and the trailing edge tip angle is greater than the blade tip trailing edge angle.

13. The impeller of claim 12, wherein the leading edge tip angle, the blade tip leading edge angle, the trailing edge tip angle and the blade tip trailing edge angle are between 20 degrees and 50 degrees.

14. The impeller of claim 11, wherein the each of the blades further comprises a leading edge tip angle and a trailing edge tip angle, wherein the trailing edge tip angle is greater than or equal to the leading edge tip angle.

15. The impeller of claim 14, wherein the leading edge tip angle is between 80 degrees and 120 degrees, and the trailing edge tip angle is between 90 degrees and 130 degrees.

16. The impeller of claim 14, wherein a difference between the trailing edge tip angle and the leading edge tip angle is less than 20 degrees.

17. The impeller of claim 16, wherein the trailing edge tip angle is greater than the leading edge tip angle.

18. The impeller of claim 11, wherein the each of the blades further comprises an upper leading edge tip radius and an upper trailing edge tip radius, and the upper trailing edge tip radius is greater than or equal to the upper leading edge tip radius.

19. The impeller of claim 18, wherein the each of the blades further comprises an upper blade tip leading edge radius and an upper blade tip trailing edge radius, and the upper blade tip trailing edge radius is greater than or equal to the upper blade tip leading edge radius.

20. The impeller of claim 19, wherein the upper trailing edge tip radius is greater than the upper leading edge tip radius, and the upper blade tip trailing edge radius is greater than the upper blade tip leading edge radius.

21. The impeller of claim 11, wherein the each of the blades further comprises an upper blade tip leading edge radius, an upper blade tip midpoint radius, an upper blade tip trailing edge radius, a lower blade tip trailing edge radius, a lower blade tip midpoint radius and a lower blade tip leading edge radius, and the lower blade tip trailing edge radius is greater than or equal to the upper blade tip trailing edge radius, the upper blade tip trailing edge radius is greater than or equal to the lower blade tip midpoint radius, the lower blade tip midpoint radius is greater than or equal to the upper blade tip midpoint radius, the upper blade tip midpoint radius is greater than or equal to the lower blade tip leading edge radius, and the lower blade tip leading edge radius is greater than or equal to the upper blade tip leading edge radius.

22. The impeller of claim 21, wherein the lower blade tip trailing edge radius is greater than the upper blade tip trailing edge radius, the upper blade tip trailing edge radius is greater than the lower blade tip midpoint radius, the lower blade tip midpoint radius is greater than the upper blade tip midpoint radius, the upper blade tip midpoint radius is greater than the lower blade tip leading edge radius and the upper blade tip leading edge radius.

* * * * *